United States Patent [19]

Fouquet

[11] Patent Number: 4,854,363

[45] Date of Patent: Aug. 8, 1989

[54] DEVICE FOR SUPPORTING MOVABLE COVER ELEMENTS

[76] Inventor: Jean M. Fouquet, 27 avenue Paul Verlaine Domaine de Villarceau, 77330 Lesigny, France

[21] Appl. No.: 185,260

[22] Filed: Apr. 19, 1988

Related U.S. Application Data

[63] Continuation-in-part of Ser. No. 907,999, Sep. 16, 1986, abandoned.

[30] Foreign Application Priority Data

Sep. 17, 1985 [FR] France ..... 85 13765

[51] Int. Cl.[4] ..... E06B 3/32

[52] U.S. Cl. ..... 160/98; 160/66; 160/266

[58] Field of Search ..... 160/98, 267.1, 273.1, 160/274, 277, 120, 84.1; 52/63, 86, 93; 403/161, 163, 119

[56] References Cited

U.S. PATENT DOCUMENTS

| | | | |
|---|---|---|---|
| 2,886,104 | 5/1959 | Swan | 160/273 R |
| 3,255,769 | 6/1966 | Lloyd | 52/63 X |
| 4,387,533 | 6/1983 | Green et al. | 52/63 X |
| 4,450,971 | 5/1984 | Kashiwabara | 403/161 X |
| 4,462,390 | 7/1984 | Holdridge et al. | 52/82 X |
| 4,593,710 | 6/1986 | Stafford et al. | 52/63 X |
| 4,596,093 | 6/1986 | Esposito | 52/63 |
| 4,598,752 | 7/1986 | Esposito | 160/273 R X |
| 4,606,157 | 8/1986 | Esposito | 160/273 R X |
| 4,610,293 | 9/1986 | Weiblen | 160/273 R X |
| 4,655,010 | 4/1987 | Arquati | 52/63 |

FOREIGN PATENT DOCUMENTS

| | | |
|---|---|---|
| 0119966 | 9/1984 | European Pat. Off. . |
| 2805683 | 2/1979 | Fed. Rep. of Germany . |

*Primary Examiner*—Ramon S. Britts
*Assistant Examiner*—David M. Purol
*Attorney, Agent, or Firm*—Wenderoth, Lind & Ponack

[57] ABSTRACT

A device has at least two longitudinal uprights (1, 2) each of which is made up of a series of juxtaposed aligned discrete sections of a given section member through which a throughway longitudinal cavity and grooves parallel to the cavity are defined. An elongate connecting device extends through the cavities of the sections and maintains them in alignment and assembled to one another. These uprights (1, 2) support transverse members (41) of an intermediate structure (30), the transverse members being engaged in the grooves of the sections. Fixing devices slidable in the grooves of the sections fix the transverse members (41) in position. Each upright may have rectilinear parts interconnected by at least one curvilinear part. The rectilinear parts consist of a single section of the section member while the curvilinear parts consist of a plurality of small sections (**10*a***) of the section member having end faces that are convergent toward the center of radius of the desired curve.

9 Claims, 12 Drawing Sheets

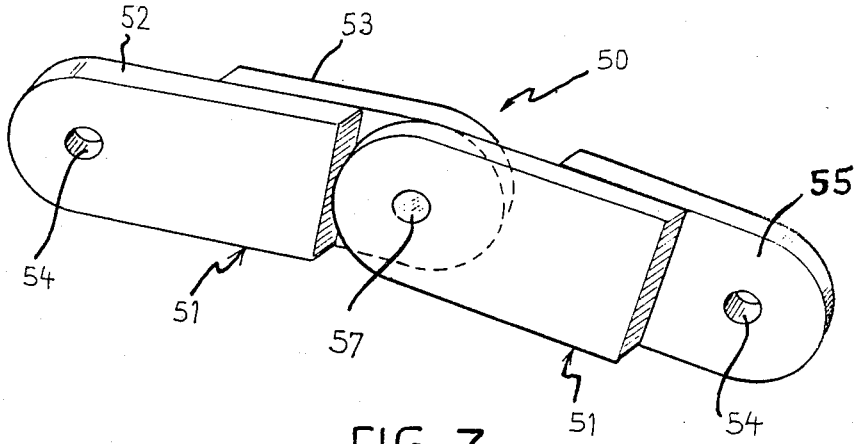
FIG. 7
FIG. 8
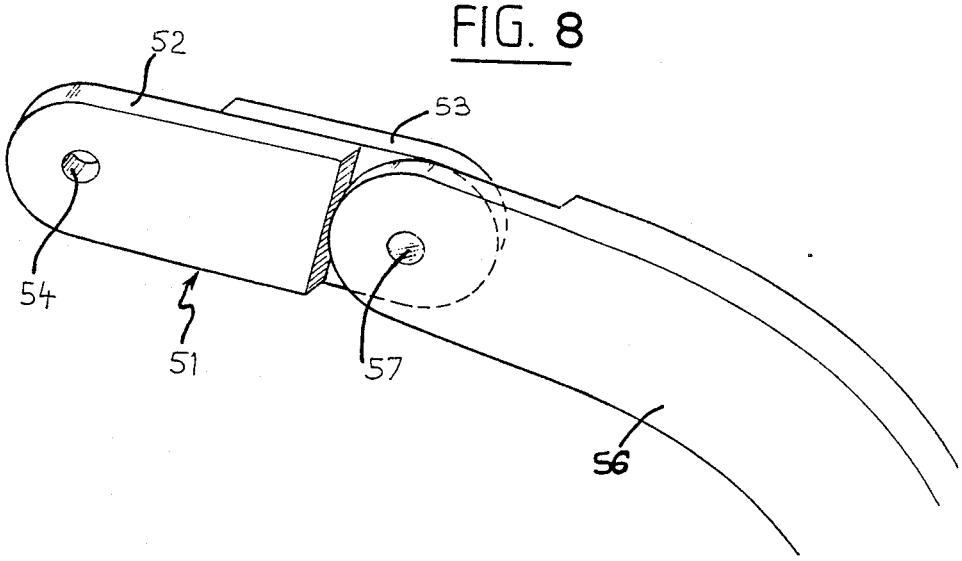

DEVICE FOR SUPPORTING MOVABLE COVER ELEMENTS

This application is a continuation-in-part, of now abandoned application Ser. No. 907,999, filed Sept. 16, 1986.

BACKGROUND OF THE INVENTION

1. Field of the Invention

The present invention relates to a support device for the construction of movable covers for various purposes, for example for covering terraces or verandas, or the temporary closing of vertical front walls.

2. Description of the Related Art

The existing systems usually comprise at least two lateral uprights each of which is formed by rectilinear portions constituted by metal section members, between which there are interposed curved parts, whereby it is possible to give the desired profile to the assembly. The lateral uprights, between which is displaced a movable element formed for example by a sheet, are used in particular for the mounting of an intermediate structure supporting the movable element.

This intermediate structure may be formed, on one hand, by a support tube including electrical or manual means for driving the movable element, and on which is fixed one of the ends of said movable element, and, on the other hand, by a load bar fixed to the other end of the movable element. The load bar is movable between the two lateral uprights in a slideway and ensures the traction of the movable element.

Furthermore, the movable element when in the deployed position is maintained by supports, termed windbreaks, which are evenly spaced apart transversely between the two lateral uprights. Each windbreak comprises a tube whose ends are fitted onto a sleeve mounted to be freely rotatable on a pin fixed inside each lateral upright.

But these known systems have many drawbacks.

First of all, the support tube for the movable element is mounted by means of a special member which is fixed to the end of the lateral uprights and is also employed for the fixing of the assembly to a wall. This arrangement consequently does not allow the support tube to be displaced along the uprights or to be mounted in another place nor does the arrangement facilitate the mounting of several support tubes (i.e. separate intermediate structures) one after another in a vertical direction extending along the uprights. Thus, the possibilities of installation are limited.

Furthermore, the curved parts interposed between the rectilinear metal section members are also formed by special members usually fixed by being bolted to the rectilinear section members. These members have a predetermined curvature and do not permt a modification of the angles of the curved parts of the lateral uprights. Moreover, in the case of special installations which do not correspond to a current profile, i.e. which include special angles, it is necessary, depending on the angle to be obtained, to specially machine a member having the desired curvature which increases the cost of the installation.

Lastly, the windbreak is fixed by drilling and by being bolted through the lateral uprights in given places so that when it is desired to modify the position of these windbreaks, the lateral uprights must be again drilled, and this of course has an adverse effect on the appearance and the strength of the assembly.

SUMMARY OF THE INVENTION

An object of the present invention is to avoid the drawbacks mentioned above and to provide a device whose construction is less expensive and whose utilization is simpler than that of known systems.

The present invention therefore provides a device for supporting movable cover elements comprising at least two longitudinal uprights formed by rectilinear and/or curved parts which are juxtaposed in series, said uprights permitting the mounting of an intermediate structure constituted by a support tube for the movable element, a load bar fixed to one of the ends of said movable element and slidable between the longitudinal uprights, and a plurality of tubes or windbreaks evenly spaced apart between said uprights for the support of the movable element in the deployed position, wherein the rectilinear and/or curved parts of the longitudinal uprights are formed, thoughout their length, by a section member of the same section forming a continous assembly. The support device comprises, on one hand, means for fixing the various elements of the intermediate structure at any point and movable by sliding along said uprights and, on the other hand, means for interconnecting said various rectilinear and/or curved parts.

According to another feature of the invention, the section member in the curved parts is formed by at least one small section of the same section member whose transverse surfaces intersect at a predetermined angle.

BRIEF DESCRIPTION OF THE DRAWINGS

The following description, given by way of non-limiting examples and shown in the accompanying drawings, will bring out the advantages and features of the invention.

In the drawings:

FIGS. 7 and 8 are two perspective views of two embodiments of the connecting means between the curved parts and the rectilinear parts of the upright;

DESCRIPTION OF THE PREFERRED EMBODIMENTS

Figure 1:
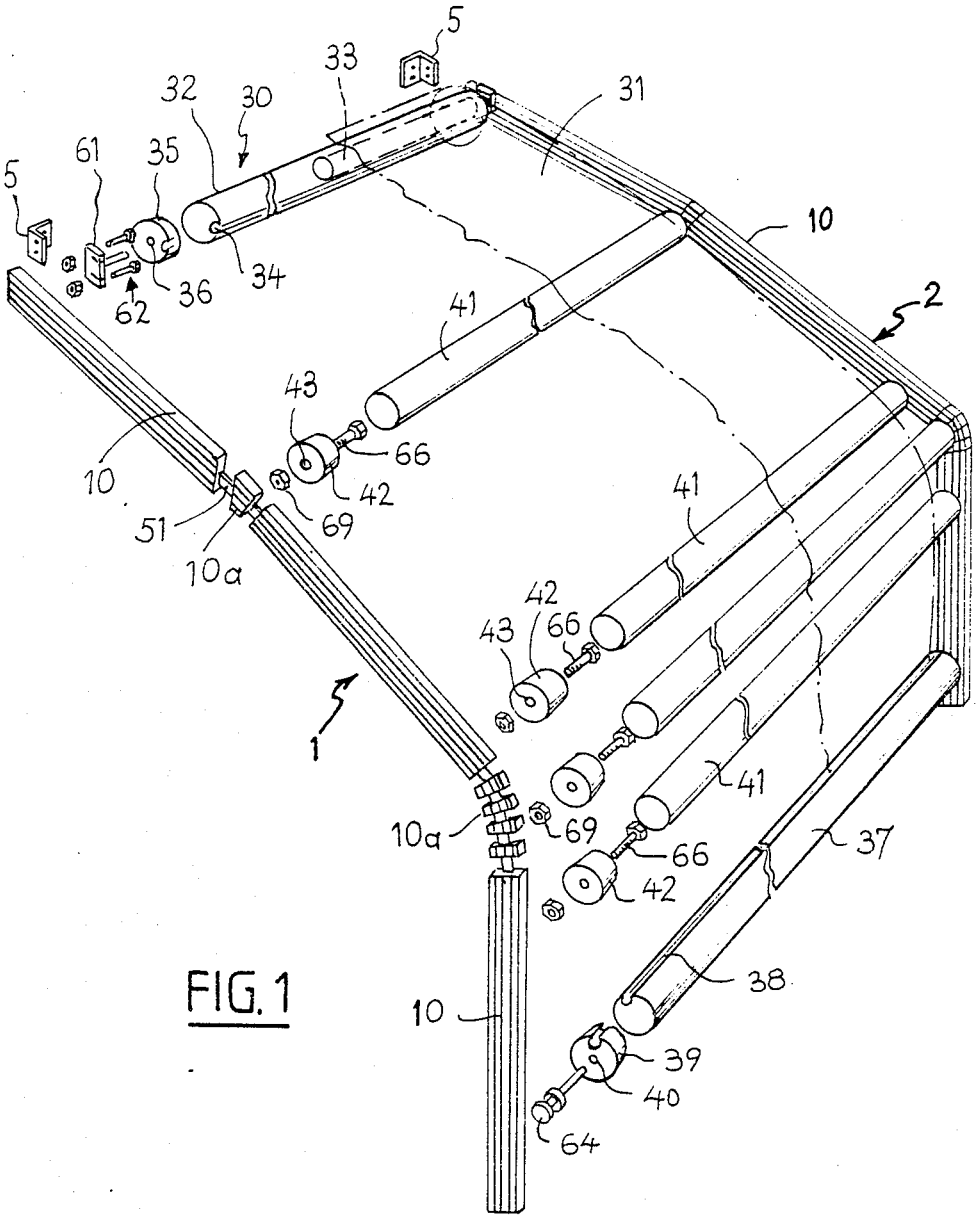
FIG. 1 is a diagrammatic exploded perspective view of a first embodiment of the device according to the present invention.

As shown in FIG. 1, the device for supporting movable cover elements comprises two longitudinal uprights 1 and 2 from each other. These uprights 1 and 2 are symmetrical with respect to each other and are each formed by rectilinear parts and curved parts constituting the framework of an assembly for covering terraces or verandas for example.

Each upright 1 and 2 is fixed, for example, to a wall by a bracket 5. Mounted between the two uprights 1 and 2 is an intermediate structure generally designated by the reference numeral 30, which supports a movable cover element 31 for example a sheet.

The sheet 31 is wound around a support tube 32 including means for rotating the tube. These rotating means in the embodiment illustrated in FIG. 1 are formed by a small motor 33 incorporated in the tube 32, and may also be formed by a manual system actuated, for example, by a crank. The tube 32 further comprises on its outer periphery a longitudinal groove 34 for fastening one of the ends of the sheet 31. Each end of the tube 32 is fitted on a sleeve 35 having a central orifice 36.

The free end of the sheet 31 is secured to a load bar 37 movable between the uprights 1 and 2, as will be understood hereinafter. This load bar 37 consists of a tube provided on its outer periphery with a longitudinal groove 33 for securing the free end of the sheet 31. The ends of the tube of the load bar 37 are fitted on a sleeve 39 having a central orifice 40.

For the purpose of supporting the sheet 31 in the deployed position, the intermediate structure 30 includes windbreaks 41 judiciously spaced apart between the uprights 1 and 2. The windbreaks 41 are each formed by a tubular member, fitted at each end on a sleeve 42 provided with a central orifice 43, and are mounted to be freely rotatable on the uprights 1 and 2.

Figure 2:
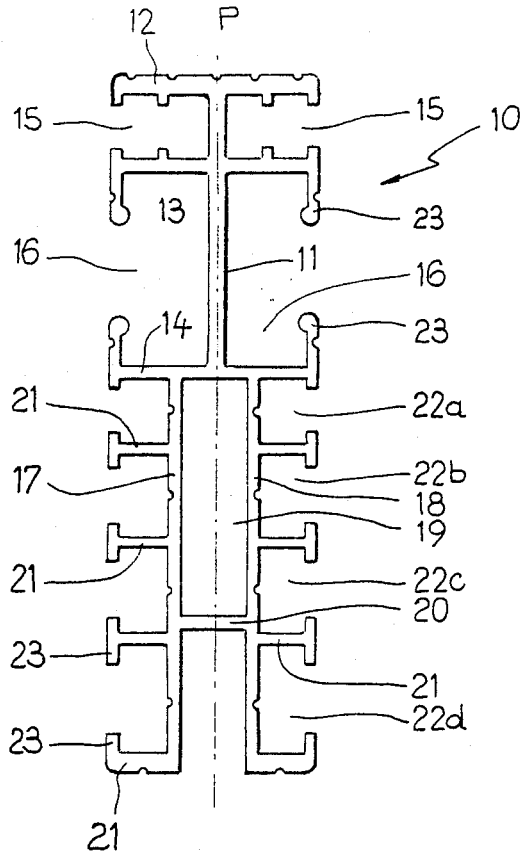
FIG. 2 is a sectional view taken in a plane transverse to the longitudinal axis of the upright of the first embodiment.

The rectilinear and/or curved parts of the longitudinal uprights 1 and 2 are constituted, throughout their length, by assembled discrete sections of a given section member 10 of so that each section has the same sectional shape which is shown in cross-section in FIG. 2.

This section member 10, which is, for example, fabricated from metal or a plastics material, has a vertical inner partition wall 11 which defines a vertical plane of symmetry P. On each side of this vertical partition wall 11 horizontal walls 12, 13, 14 form, in the longitudinal direction of the section member and one below the other, respectively a groove 15 and groove or slideway 16.

Below the horizontal wall 14, the section member 10 has, on each side of the plane of symmetry P, two parallel vertical partition walls 17 and 18 which extend downwardly and define a longitudinal central cavity 19 defined in its lower part by a horizontal inner plate 20. On the outer surface of the vertical partition walls 17 and 18, horizontal walls 21 define therebetween a plurality, for example four, of superimposed longitudinal grooves 22*a*, 22*b*, 22*c*, 22*d*.

The ends of the horizontal walls 12, 13, 14, and 21, are provided with small vertical flanges 23 which partly close the grooves 15 and 22 and the slideway 16 while defining therebetween a sufficient opening for the mounting of the intermediate structure 30.

In the first embodiment illustrated in FIGS. 1 and 2, the section member 10 therefore includes, throughout its length, symmetrically relative to the plane P and on each lateral side, an upper groove 15, a slideway 16 and four small grooves 22*a*, 22*b*, 22*c*, 22*d* in superimposed relation to one another.

The dimensions and the distances between the axes of the grooves and the slideway are chosen to satisfy required standards.

As mentioned before, the uprights 1 above and 2 formed by assembled sections of a section member 10 having a contour when viewed in a vertical plane of the uprights which may include rectilinear and/or curved parts.

Depending on the length of the rectilinear parts, these parts may have a plurality of sections of the sections members which are in juxtaposed series relation to one another. In this case, the ends of the sections of the section member may be beveled to create a ridge angle which increases the rigidity of the assembly.

Several devices may be placed adjacent to one another and may be linked together as will be further described with reference to FIG. 3.

Figure 3:
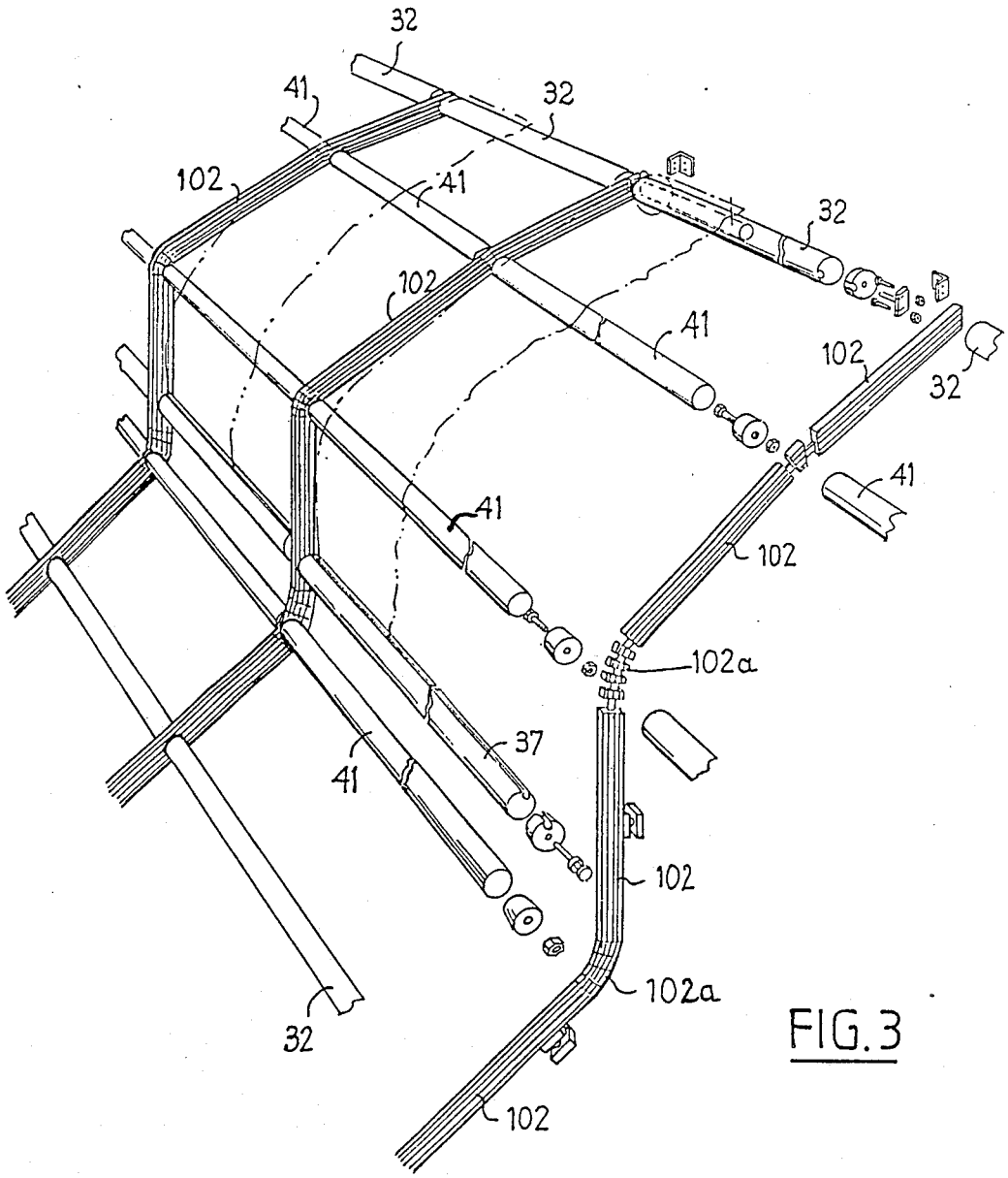
FIG. 3 is a diagrammatic exploded perspective view of a second embodiment of the device according to the present invention.
Figure 4:
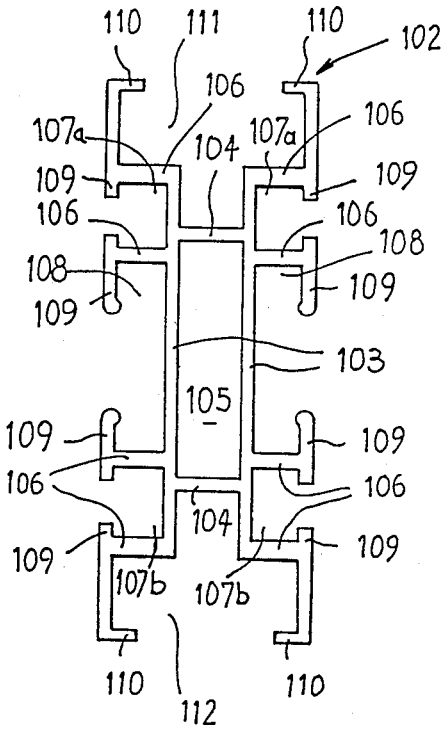
FIG. 4 is a sectional view taken in a plane transverse to the longitudinal axis of the upright of the second embodiment.
Figure 5:
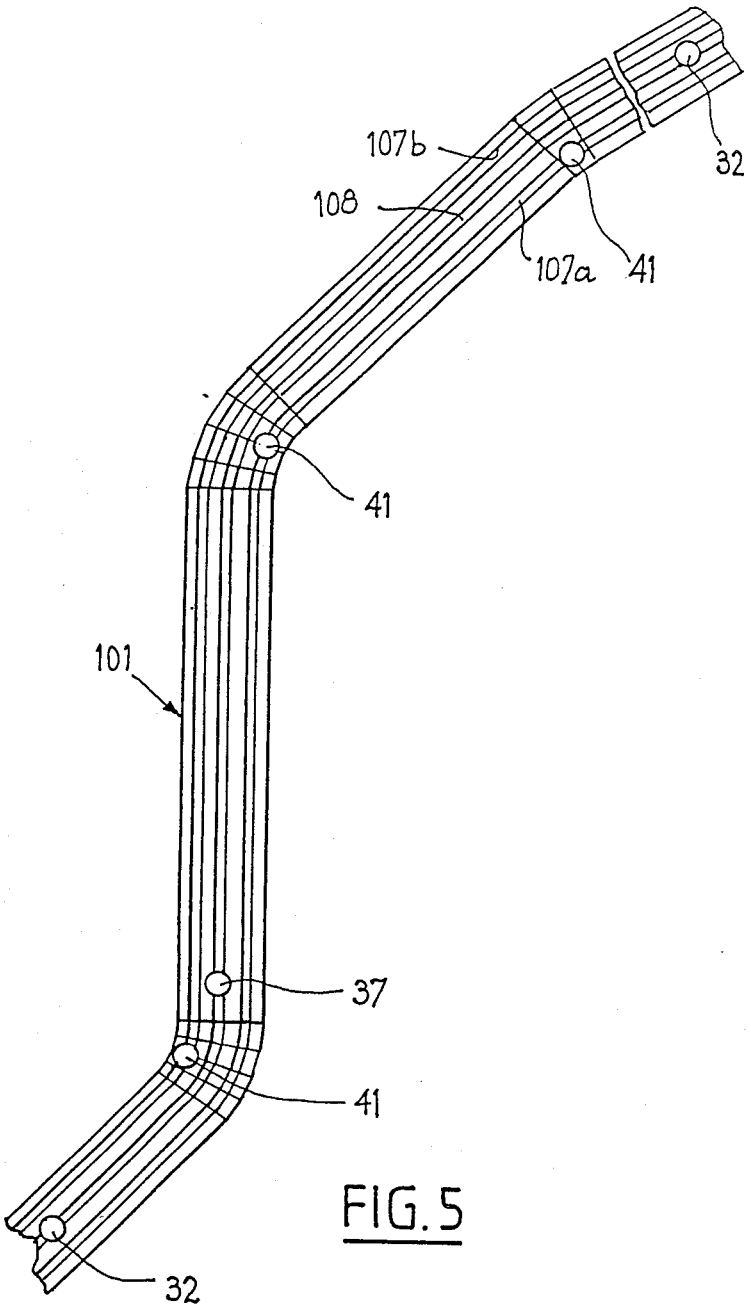
FIG. 5 is a longitudinal cross-sectional view taken through an intermediate structure showing an upright and the relative positions of the different elements comprising the intermediate structure.

FIGS. 3–5 show a second embodiment of the device for supporting movable cover elements. The intermediate structures shown in FIG. 3 are the same as in the first embodiment and therefore, the corresponding elements have the same reference numerals. Thus, the intermediate structure of each device comprises a support tube 32, several windbreaks 41 and a load bar 37.

FIG. 3 further shows several adjacent devices linked together to form an assembly. The devices are disposed in an adjacent relation with respect to both the horizontal and the vertical and are interconnected through intermediate, common uprights 101. Each common upright 101 supports two devices disposed side by side with respect to the horizontal and can also, as shown in FIG. 3, support two or more devices placed one after another with respect to the vertical.

As in the first embodiment, the uprights 101 according to the second embodiment comprise rectilinear and/or curved parts constituted, through their length, by a section member 102 having the same sectional shape which is shown in cross section in FIG. 4.

This section member 102, which is comprised of metal or a plastic material, for example, has a symmetric structure and comprises a central rectangular part consisting of two parallel vertical partition walls 103 interconnected by two horizontal inner plates which collectively define a longitudinal central cavity 105 extending throughout the length of the uprights 101.

The section member 102 furthermore comprises horizontal walls 106 extending outwardly from the vertical partition wall 103 and defining together therewith several grooves 107*a*, 107*b* and a groove or central slideway 108 on each longitudinal side of the upright 101.

The ends of the horizontal walls 106 are provided with small vertical flanges 109 which partly enclose the grooves 107*a*, 108*b*. The upper and lower flanges have at their outer ends a horizontal wall 110 projecting inwardly and defining grooves 111 and 112 with the horizontal inner plates 104. The upper and lower grooves 11 and 112 can be T-shaped as shown in FIGS. 4, or they can also have the same rectangular shape as do the side grooves 107*a*, 107*b*.

The openings of the side grooves 107*a*, 107*b* are sufficient for the mounting of an intermediate structure on one or both sides of an upright. The upper and lower grooves 111 and 112 can cooperate with fixing or holding devices.

FIG. 5 is a longitudinal cross-sectional view taken through an intermediate structure showing an upright 101 and the position of the different elements comprising the intermediate structure. At the top of the figure, a support tube 32 is mounted in a central slideway 108. The upright is then slightly inclined inward and a windbreak 41 is placed in a lower side groove 107*b* in the middle of a curved section. Then another curved section providing an inward inclination is provided and a windbreak 41 is disposed in the same way as in the first one, i.e. in the lower side groove 107*b* in the middle of the curved section. The upright 101 is then inclined slightly outward and a windbreak 41 is placed in the upper side groove 107*b*. A load bar 37 is movably mounted in the central slideway 108 between the windbreaks in the upper and lower side grooves 107*a* and 107*b*. A second support tube 32 is mounted in the central slideway 108 below the third curved section.

In the substantially curved sections of the first and second embodiment (FIGS. 1, 3 and 6), the uprights 1, 2 and 101 are formed by a plurality of small rectilinear sections 10*a* and 102*a*, respectively, of the section members 10 and 102 which are pre-cut in such a manner that the transverse end; surfaces of each small section 10*a* make therebetween an angle A whose apex faces the centre of curvature. This angle A is for example equal to 10°.

Consequently, in accordance with the desired curvature, it is sufficient to juxtapose in series relation a plurality of small sections 10*a*, 102*d* of the section member.

In the case where the desired curvature does not exactly correspond to the various possibilities with sections at 10°, the fitter may cut directly on the site the end of the rectilinear section. For example, if the angle to be formed is equal to 85°, the fitter will juxtapose eight 10° sections so as to form an angle of 80° and will cut the end of the rectilinear part of the upright at 5°.

Since the rectilinear parts and/or curved parts of the uprights 1 and 2 are formed by identical sections of section members having the same sectional shape, on each lateral side of said uprights a group of grooves and slideways are provided which are perfectly continuous.

Figure 6:
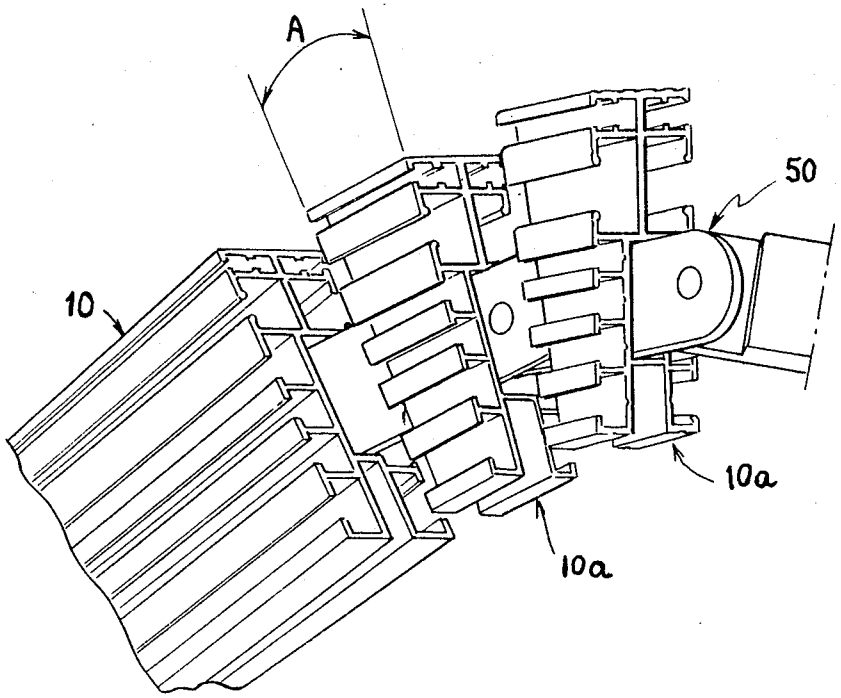
FIG. 6 is a diagrammatic exploded perspective view of a rectilinear part and a curved part of an upright according to the first embodiment of the present invention.

The various sections 10, 10*a* and 102*a*, respectively of of common given section member are maintained in position by a connecting means 50 which extends through the interior of the central cavity 19 of each section, as shown diagrammatically in FIG. 6.

With reference now to FIGS. 7 and 8, this connecting means will be described in more detail.

The connecting means 50, whose width and thickness substantially correspond to the dimensions of the cavity 19, comprises at least two links 51 which are articulated together (FIG. 7) so that the connecting means is bendable in a vertical plane passing through the respective upright.

Each link 51 is formed by two plates 52 and 53 each of which has a rounded end portion provided with an aperture 54 and a straight end. The two plates 52, 53 are fixed together in head-to-toe relation and slightly offset in the longitudinal direction so as to form at each end of the link a flat face 55 against which the end portion of the following link is applied. The links 51 are articulated together by a small pin 57 extending through the apertures 54 so as to form a continuous articulated chain element.

It will be clear that each link 51 may be formed by a single machined member having in each of its end portions a flat face and an aperture. Furthermore, one of the links may also be formed by a longer member 56 having a given curvature, as shown in FIG. 8.

The juxtaposition of the sections 10 and 10*a* of the section member is achieved by introducing the articulated links 51 into the cavity 19, which thus centers the various sections with respect to one another in accordance with the desired curvature the links automatically adapting themselves to this curvature as shown by the correctly assembled juxtaposed sections of the upright on the right side of the device shown in FIG. 1.

FIG. 6 is a cross-sectional view of a section 10 of a section member on which the various component parts of the intermediate structure supporting the movable cover are fixed.

Bearing in mind the symmetry of the section member 10, all the elements may be fixed on the same side, for example in the case where the section member constitutes a lateral upright, or on both sides, in the case where the section member constitutes an intermediate upright for supporting a movable cover on each side.

The sleeve 35 of the support tube 32 for the sheet is mounted on a pin 60 integral with a plate 61 fixed in the grooves 15 and 22*a* of the section member in such manner that the axis of the support tube 32 is placed on the axis of the slideway 16. The plate 61 is fixed in each groove by a quarter-turn clamping system 62 comprising a screw 62*a* cooperating with a nut or a pellet 62*b* placed in the corresponding groove. When assembling, the end of the screw 62*a* bears against the inner end of the groove, which is effective to locate the nut 62*b* against the inner flanges of said groove.

The tube 37 of the load bar is fitted on the sleeve 39 in which is mounted a pin 63 having at its opposite end a roller 64 which penetrates the slideway 16 in such manner that the load bar can be moved along said slideway.

The axes of the support tube 32 and the load bar are therefore located in the same plane.

The windbreaks 41, each comprising a tubular member fitted at each end on the sleeve 42, are fixed in the grooves 22*d* of the section member also by means of a quarter-turn clamping system 65.

This system 65 comprises a screw 66 whose head 67 is placed inside the sleeve 42. The body of the screw 66 extends through the sleeve 42 in the aperture 43 and clamping lock-nuts 68 are screwed on the body of the screw 66 from the other side of the sleeve.

The windbreak 41 is fixed in the groove 22*d* by a nut or a pellet introduced in said groove. When assembling, the end of the screw screwed into the nut 69 bears against the inner end of the groove 22*d*, which is effective to locate the nut 69 against the flanges of said groove 22*d*. The clamping is completed by means of lock-nuts 68.

The windbreak is therefore fixed in position by turning the screw 66 through a quarter of a turn.

Since this manner of securing the intermediate structure, and in particular the support tube 32 and the windbreaks 41, solely by a quarter-turn clamping screw and nut system cooperating with a groove of the section member, no drilling of said section member is required and the supports may be placed in any position along the uprights and may be above all shifted as desired by sliding without any particular requirements.

Figure 9:
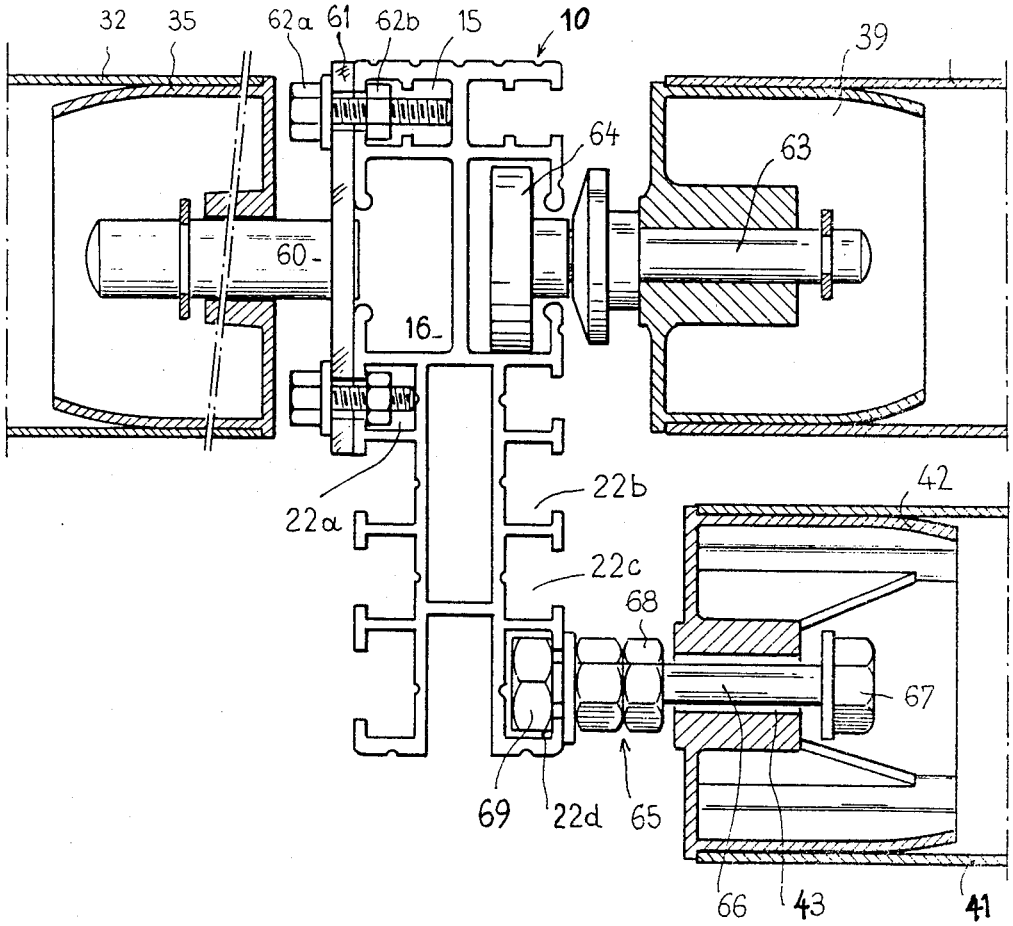
FIG. 9 is a view similar to FIG. 2 in which the elements of the intermediate structure supporting the movable element are diagrammatically represented.
Figure 10:
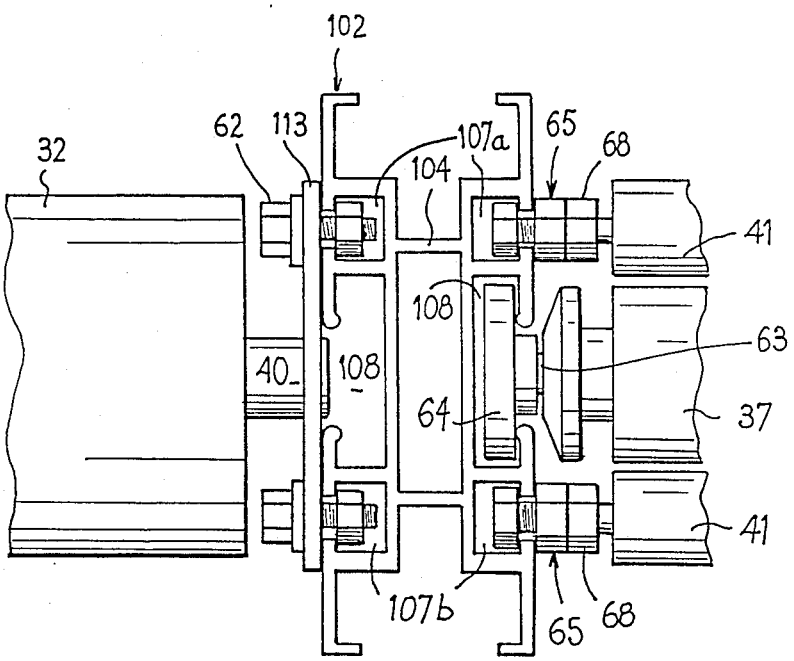
FIG. 10 is a view similar to FIG. 4 in which the elements of the intermediate structure supporting the movable element are diagrammatically represented.

FIG. 10 is a cross-sectional view of a section member 102 on which the various component parts of the intermediate structure supporting the movable cover are fixed. These component parts are described in detail with reference to FIG. 9.

According to the second embodiment as well as to the first one, these elements may be fixed on just one side of the upright, or on both sides thereof when the section member is used as an intermediate upright for supporting a movable cover on each side thereof.

The pin 60 of the support tube 32 is integral with a plate 113 fixed in the grooves 107*a* and 107*b* of the section member in such a manner that the axis of the support tube 32 extends along an axis of the central slideway 108. The plate 113 is fixed in each groove by the same quarter-turn clamping system 62 as described above with reference to FIG. 9.

The pin 63 of the load bar 37 has a roller 64 at one end thereof which is disposed in the slideway 108 in such a manner that the load bar can be moved along said slideway.

The windbreaks 41 are fixed in the grooves 107*a* and 107*b* of the section member by means of a quarter-turn clamping system 65 of the same type as described above with reference to FIG. 9. The clamping is completed by means of lock-nuts 68.

Furthermore, the grooves 22*b*, 22*c*, and 107*a*, 107*b*, respectively, may be employed for securing other elements, such as for example rollers of a cable or a belt driving the load bar. The other elements are also mounted by means of a quarter-turn clamping system.

Figure 11:
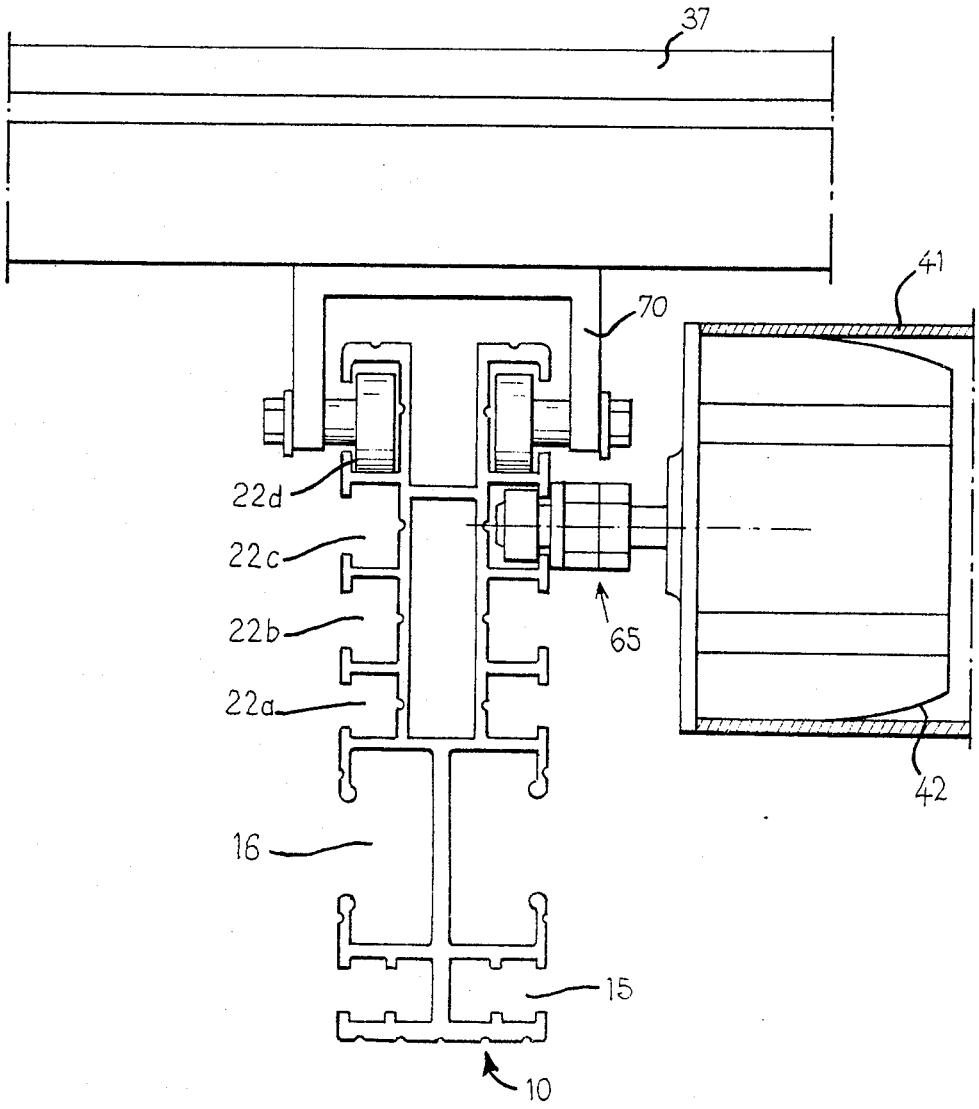
FIG. 11 is a cross-sectional view of an upright showing a modification of a device according to the present invention.

If a single piece cover having a large width is required, the same section member 10 is employed, but in an inverted position as shown in FIG. 11. Indeed, this arrangement enables a single load bar 37 fixed to a carriage 70 to be mounted on top of the section member. The carriage 70 is moved along the section member in the groove 22*d* by means of small wheels 71.

In accordance with the diameter of the tube 41 of the windbreaks, said windbreaks are secured in the grooves 22*a*, 22*b*, or 22*c* also by means of a quarter-turn clamping system so that the tube 41 extends beyond the top of the upper surface of the section member 10 for supporting the sheet.

In this arrangement, it is also possible to superimpose two sheets as, for example, a fine sheet of the mosquito-net type in the lower part of the section member in the region of the groove 15 and, above, a movable watertight sheet driven by the load bar 37.

The device according to the invention may be used for closing off vertical front walls by means of a movable sheet or blind. The uprights 1 and 2 are vertically secured to a front wall 6 (FIG. 8) for example on each side of 12 row of windows 7 on several floors.

A single sheet may close the windows in several floors and, in this case, a support tube is mounted in the upper part of the uprights and a load bar descends throughout the height.

Figure 12:
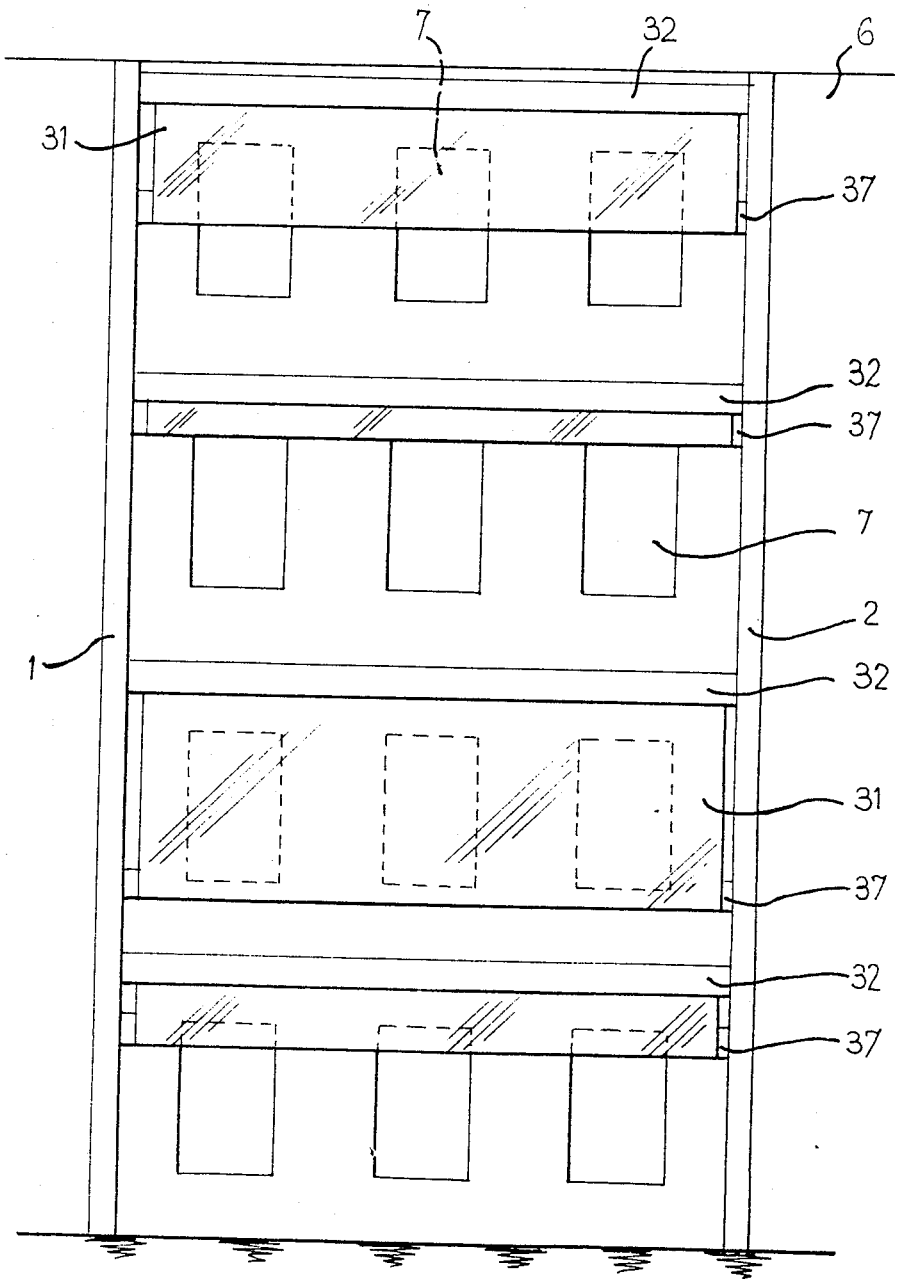
FIG. 12 is a plan view of a second modification of a device according to the present invention.
Figure 13:
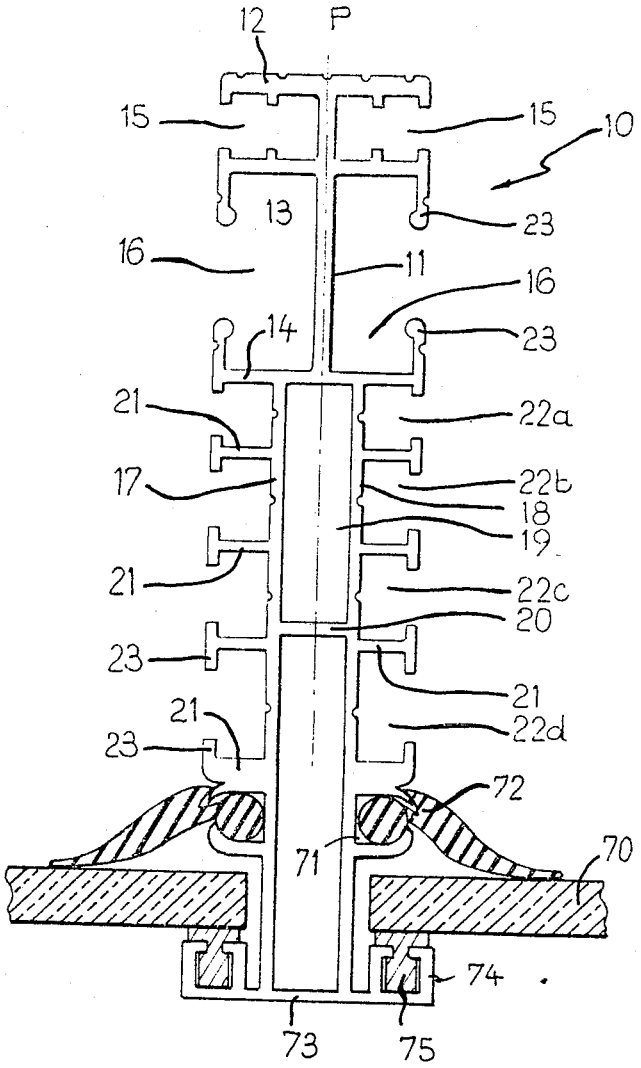
FIG. 13 is a plan view of a third modification of a device according to the present invention.

If it is desired to close off the windows of each floor separately (FIG. 12), a support tube is placed between each floor and a load bar 37 connected to a sheet 31 is moved.

This arrangement with a plurality of support tubes 14 and a load bar on the same uprights is possible due to the fixing of the support tubes directly on the section members of the uprights with no use of an intermediate element.

The device according to the invention may also be used for closing off and supporting glass panes of verandas or glass roofs or casings.

In this case, the section member 10 includes, in addition to the means for supporting the sheet, means for supporting the panes of glass 70 and sealing elements (FIG. 9). For this purpose, the section member is provided, throughout its length in a symmetrical manner with respect to the plane P and on each lateral side, with a small groove 71 in which is placed a sealing element 72 which has for example a lip portion applied against the pane of glass 70.

For the purpose of supporting the pane of glass 70, the section member 10 has in its lower part a small horizontal plate 73 including, on each side of the plane of symmetry, a longitudinal cavity in which a sealing element 75 is mounted. The pane of glass 70 bears against the sealing element 75.

The device according to the invention therefore provides a continuity of the section member throughout the length of the uprights and also permits the construction of all possible arrangements, which increases the possibilities of installation.

Furthermore, the installation is extremely flexible and easy to construct, since it does not require drilling or the use of special fastening elements.

What is claimed is:

1. A device for supporting a movable cover element comprising:

at least two uprights each of which extends longitudinally in a respective one of spaced apart substantially vertical planes, each of said uprights comprising a series of discrete sections, each of said sections having a longitudinal axis, the same cross-sectional shape taken perpendicular to said axis as do the other said sections, a throughway cavity defined therein and extending in the same direction as said axis, and grooves extending parallel to said cavity so that a continuous cavity extends through and continuous grooves extend along each of said uprights, said continuous cavity and said continuous grooves defined by the throughway cavities and the grooves, respectively, of the discrete sections of each of said series of discrete sections;

elongate connecting means extending through a portion of said continuous cavity extending through each of said uprights for aligning said discrete sections of each said series in an assembled configuration and for maintaining said discrete sections in alignment with one another in said configuration, each of said discrete sections of each said series having transverse end faces which abut with respective said end faces of adjacent ones of said discrete sections aligned in said configuration, said end faces of each said discrete section each being oriented relative to said longitudinal axis thereof so as to conform to said configuration when abutting adjacent ones of said discrete sections;

an intermediate structure extending transversely between said two uprights comprising spaced apart parallel members each having a pair of ends slidably mounted to said uprights in said continuous grooves extending therealong; and fixing means slidable in said continuous grooves with the ends of at least some of said parallel members for releasably fixing said ends of at least some of said parallel members to said uprights, each of said uprights comprising rectilinear parts and at least one curvilinear part interconnecting the rectilinear parts, the rectilinear parts each consisting of a single discrete section of said series, and the curvilinear part comprising a plurality of small discrete sections of said series which have the end faces thereof divergent away from the center of the radius of a curve extending along the curvilinear part, said small sections each extending tangentially to the curve.

2. A device as claimed in claim 1, wherein said elongate connecting means has a predetermined curvature in said vertical plane extending through each of said uprights so as to be conformable to said configuration of the uprights.

3. A device as claimed in claim 2, wherein said elongate connecting means comprises a series of articulated links.

4. A device as claimed in claim 1, and further comprising at least one sheet-like cover element having an upper end and a lower end, wherein said parallel members of said intermediate structure include at least one transverse support tube to which the upper end of said at least one cover element is secured, a transverse load member freely slidable in respective ones of said continuous grooves extending along each of said uprights, the lower end of said at least one cover element secured to said transverse load member so as to be slidable along said uprights therewith, and transverse support members for supporting said at least one cover element.

5. A device as claimed in claim 1, wherein each of said fixing means comprises a flange means bordering a respective one of said continuous grooves extending along each of the uprights and a quarter-turn clamping system for clamping said at least some of said parallel members against said flange.

6. A device as claimed in claim 1, wherein each of said uprights has said continuous grooves extending along opposite sides thereof, and the cross-sectional shape of each of said discrete sections is symmetrical about a plane passing through the longitudinal axis thereof.

7. A device as claimed in claim 4, wherein said at least one support tube comprises a plurality of support tubes mounted to said uprights at positions that are spaced apart from one another therealong, and said at least one transverse load member comprises a plurality of transverse load members also mounted to said uprights at positions that are spaced apart from one another therealong.

8. A device as claimed in claim 1, wherein said series of discrete members includes means for supporting at least one pane of glass and sealing means for forming a seal between the pane of glass and said series.

9. In a device for supporting a movable cover element and comprising at least two uprights each of which extends longitudinally in a respective one of spaced apart substantially vertical planes, and spaced apart members extending transversely to and between said uprights, the improvement wherein:

said uprights each comprise a series of discrete sections, each of said sections having a longitudinal axis, the same cross-sectional shape taken perpendicular to said axis as do the other said sections, a throughway cavity defined therein and extending in the same direction as said axis, and grooves extending parallel to said cavity so that a continuous cavity extends through and continuous grooves extend along each of said uprights, said continuous cavity and said continuous grooves defined by the throughway cavities and the grooves, respectively of the discrete sections of each of said series of discrete sections, elongate connecting means extending through a portion of said continuous cavity extending through each of said uprights for aligning said discrete sections of each said series in an assembled configuration and for maintaining said discrete sections in alignment with one another in said configuration, each of said discrete sections of each said series having transverse end faces which abut with respective said end faces of adjacent ones of said discrete sections aligned in said configuration, said end faces of each said discrete section each being oriented relative to said longitudinal axis thereof so as to conform to said configuration when abutting adjacent ones of said discrete sections, and each of said uprights comprising rectilinear parts and at least one curvilinear part interconnecting the rectilinear parts, the rectilinear parts each consisting of a single discrete section of said series, and the curvilinear part comprising a plurality of small discrete sections of said series which have the end faces thereof divergent away from the center of the radius of a curve extending along the curvilinear part, said small sections each extending tangentially to the curve.

* * * * *